US007437788B1

(12) United States Patent
Holman

(10) Patent No.: US 7,437,788 B1
(45) Date of Patent: Oct. 21, 2008

(54) PILLOW

(76) Inventor: Elward L. Holman, 4617 Old Fox Trail, Chesapeake, VA (US) 23321

( * ) Notice: Subject to any disclaimer, the term of this patent is extended or adjusted under 35 U.S.C. 154(b) by 0 days.

(21) Appl. No.: 11/655,634

(22) Filed: Jan. 19, 2007

(51) Int. Cl.
*A47G 9/10* (2006.01)

(52) U.S. Cl. ..... 5/636; 5/638; 5/639; 5/645

(58) Field of Classification Search ..... 5/636–640, 5/643, 645
See application file for complete search history.

(56) References Cited

U.S. PATENT DOCUMENTS 3,602,928 A * 9/1971 Helzer ..... 5/644
3,949,437 A * 4/1976 Gritsch ..... 5/643
4,375,112 A * 3/1983 Leonhart ..... 5/639
6,003,177 A * 12/1999 Ferris ..... 5/636
6,230,348 B1 * 5/2001 Patrikakis ..... 5/636
D486,028 S * 2/2004 Cathey ..... D6/601
7,165,279 B1 * 1/2007 Georgescu ..... 5/636

* cited by examiner

*Primary Examiner*—Michael Trettel

(57) ABSTRACT

A pillow is disclosed. An illustrative embodiment of the pillow includes a pillow body having a generally elongated main segment and a pair of spaced-apart extension segments extending from the main segment; a pillow interior defined between the main segment and the extension segments; and a pair of pillow arms extending from the pillow body into the pillow interior.

9 Claims, 1 Drawing Sheet

PILLOW

FIELD

The present invention relates to pillows. More particularly, the present invention relates to a hairstyle-preserving pillow.

BACKGROUND

Conventional pillows have a generally rectangular shape and include an enclosure which filled with a soft filling material. A pillowcase is typically fitted over the enclosure. Conventional pillows tend to distort the shape of a user's hair during use. Therefore, a pillow is needed which preserves a user's hairstyle during use.

SUMMARY

The present invention is generally directed to a pillow. An illustrative embodiment of the pillow includes a pillow body having a generally elongated main segment and a pair of spaced-apart extension segments extending from the main segment; a pillow interior defined between the main segment and the extension segments; and a pair of pillow arms extending from the pillow body into the pillow interior.

BRIEF DESCRIPTION OF THE DRAWINGS

The invention will now be described, by way of example, with reference to the accompanying drawings, in which.

DETAILED DESCRIPTION

Figure 1:
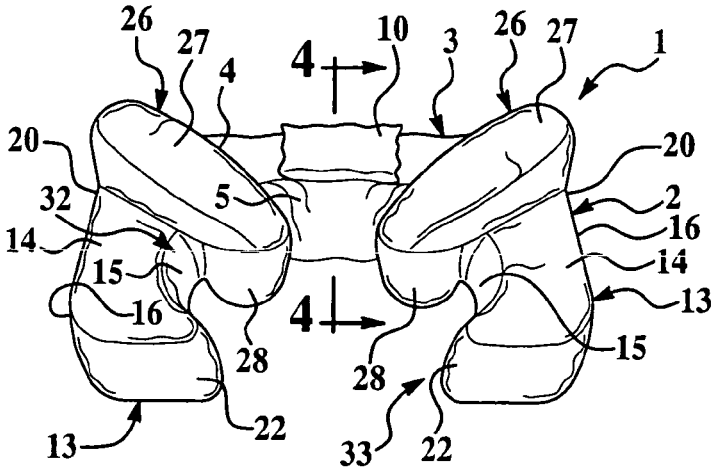
FIG. 1 is a front perspective view of an illustrative embodiment of the pillow.

Referring to the drawings, an illustrative embodiment of the pillow is generally indicated by reference numeral 1. As shown in cross-section in FIG. 1, the pillow 1 includes a pillow body 2 having an enclosure 36 and a filling 37 provided in the enclosure 36. The enclosure 36 of the pillow body 2 may be any suitable type of material including but not limited to cotton, polyester, silk or any blend or combination thereof. The filling 37 of the pillow body 2 may be any suitable resilient padding material including but not limited to feathers or foam.

Figure 2:
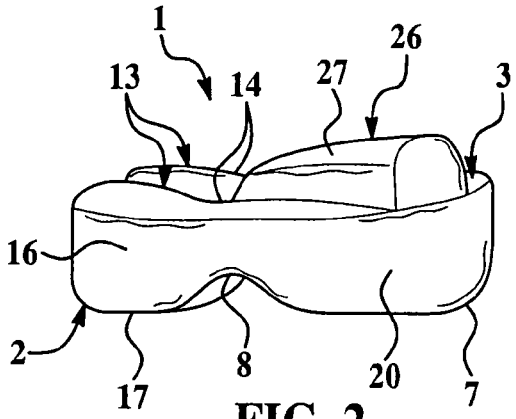
FIG. 2 is a side view of an illustrative embodiment of the pillow.
Figure 3:
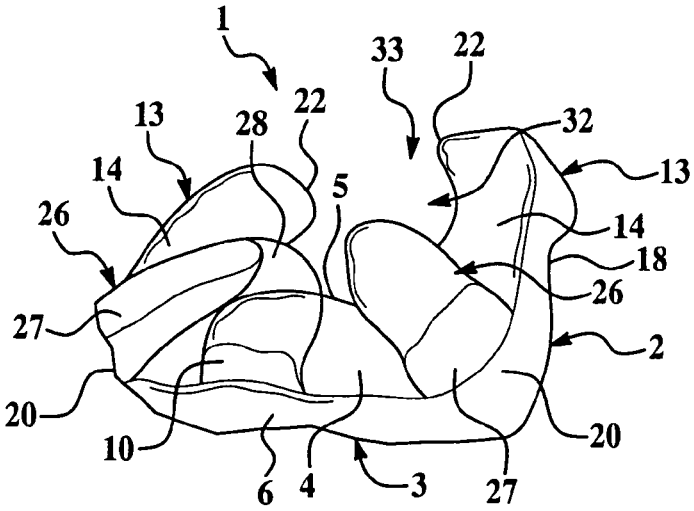
FIG. 3 is a rear perspective view of an illustrative embodiment of the pillow.
Figure 4:
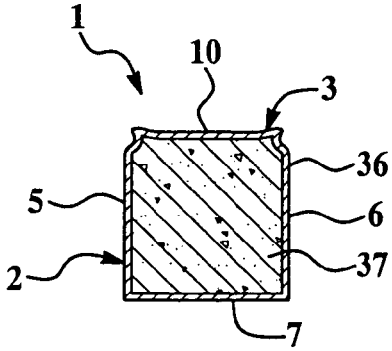
FIG. 4 is cross-sectional view taken along 4-4 of FIG. 1.

As shown in FIGS. 1-3, the pillow body 2 typically has a generally C-shaped configuration and includes an elongated main segment 3. As shown in FIG. 4, the main segment 3 may have a generally rectangular cross-section and typically has a top surface 4, an interior surface 5, an exterior surface 6 and a bottom surface 7. However, the pillow body 2 may have any suitable alternative cross-section. In some embodiments of the pillow 1, a pad 10 protrudes from the top surface 4 of the pillow body 2.

An extension segment 13, which may be elongated, extends from each end of the main segment 3 of the pillow body 2 at a segment junction 20. The extension segments 13 are disposed in generally parallel relationship with respect to each other. Each extension segment 13 may have a cross-sectional configuration which is the same as that of the main segment 3 of the pillow body 2. In some embodiments of the pillow 1, each extension segment 13 has a generally rectangular cross-section and includes a top surface 14, an interior surface 15, an exterior surface 16 and a bottom surface 17. As shown in FIG. 2, a notch 18 may be provided in the bottom surface 17 of each extension segment 13. As shown in FIGS. 1 and 3, a pillow interior 32 is defined by and between the main segment 3 and the extension segments 13 of the pillow body 2. The interior surface 5 of the main segment 3 and the interior surfaces 15 of the respective extension segments 13 face the pillow interior 32.

In some embodiments of the pillow 1, an extension segment protuberance 22 extends from each extension segment 13. The extension segment protuberances 22 of the respective extension segments 13 extend toward each other. A pillow gap 33 is defined between the extension segment protuberances 22 and communicates with the pillow interior 32.

A pair of pillow arms 26 extends from the pillow body 2, into the pillow interior 32. Like the pillow body 2, each pillow arm 26 includes an enclosure 36 which is filled with a filling 37, as shown in FIG. 3. As shown in FIGS. 1-3, each pillow arm 26 includes a generally elongated arm body 27 which extends from the pillow body 2, into the pillow interior 32. The arm body 27 of each pillow arm 26 typically extends from the segment junction 20 between the main segment 3 and each extension segment 13 of the pillow body 2, at a generally acute angle with respect to the longitudinal axis of the main segment 3. A pillow head 28 extends from the arm body 27 of each pillow arm 26 and is situated in the pillow interior 32. The pillow head 28 of each pillow arm 26 may be sewn or otherwise attached to the interior surface 5 of the main segment 3 and/or the interior surface 15 of the corresponding extension segment 13.

In typical application of the pillow 1, the pillow body 2 rests on a flat surface (not shown) such as a bed, for example. A user (not shown) rests his or her head on the main segment 3 of the pillow body 2 and on the pillow arms 26, with the user's neck (not shown) typically extending through the pillow gap 33. The configuration of the pillow 1 minimizes distortion of the user's hair as the user comfortably rests his or her head on the pillow 1.

While the preferred embodiments of the invention have been described above, it will be recognized and understood that various modifications can be made in the invention and the appended claims are intended to cover all such modifications which may fall within the spirit and scope of the invention.

What is claimed is:

1. A pillow, comprising:

a pillow body having a generally elongated main segment and a pair of spaced-apart extension segments extending from said main segment;

a pillow interior defined between said main segment and said extension segments;

a pair of pillow arms extending from said pillow body into said pillow interior; and a pair of extension segment protuberances extending from said pair of extension segments, respectively, and a pillow gap defined between said pair of extension segment protuberances and communicating with said pillow interior.

2. The pillow of claim 1 further comprising a pad provided on said main segment.

3. The pillow of claim 1 wherein each of said pillow arms comprises an elongated arm body extending from said pillow body into said pillow interior and an arm head carried by said arm body.

4. The pillow of claim 3 wherein said arm head is situated in said pillow interior.

5. The pillow of claim 4 wherein said arm head is attached to said pillow body.

6. The pillow of claim 1 further comprising a pair of notches provided in said pair of extension segments, respectively.

7. A pillow, comprising:

a generally C-shaped pillow body having a generally elongated main segment and a pair of spaced-apart extension segments extending from said main segment at a pair of segment junctions, respectively, in generally parallel relationship with respect to each other;

wherein each of said main segment and said pair of extension segments has a generally rectangular cross-section including a top surface, an interior surface, an exterior surface and a bottom surface;

a pair of extension segment protuberances extending from said pair of extension segments, respectively;

a pillow interior defined between said interior surface of said main segment and said interior surface of each of said pair of extension segments;

a pillow gap defined between said pair of extension segment protuberances and communicating with said pillow interior; and a pair of pillow arms having a pair of generally elongated arm bodies extending from said pillow body at said pair of segment junctions, respectively, into said pillow interior and a pair of arm heads carried by said pair of arm bodies, respectively, and situated in said pillow interior.

8. The pillow of claim 7 wherein each of said pair of arm bodies is disposed at a generally acute angle with respect to said main segment.

9. The pillow of claim 7 further comprising a pad provided on said top surface of said main segment and a notch provided in said bottom surface of each of said pair of extension segments.

* * * * *